US009968515B2

(12) United States Patent
Kwak

(10) Patent No.: US 9,968,515 B2
(45) Date of Patent: May 15, 2018

(54) MASSAGING MACHINE

(71) Applicant: Charles Chang Kwak, Seoul (KR)

(72) Inventor: Charles Chang Kwak, Seoul (KR)

( * ) Notice: Subject to any disclaimer, the term of this patent is extended or adjusted under 35 U.S.C. 154(b) by 480 days.

(21) Appl. No.: 14/362,581

(22) PCT Filed: Dec. 4, 2012

(86) PCT No.: PCT/KR2012/010438

§ 371 (c)(1),
(2) Date: Jun. 3, 2014

(87) PCT Pub. No.: WO2013/085257

PCT Pub. Date: Jun. 13, 2013

(65) Prior Publication Data

US 2014/0371784 A1 Dec. 18, 2014

(30) Foreign Application Priority Data

Dec. 6, 2011 (KR) ..... 10-2011-0129800

(51) Int. Cl.

| | |
|---|---|
| ***A61H 39/00*** | (2006.01) |
| ***A61H 39/04*** | (2006.01) |
| ***A61H 7/00*** | (2006.01) |
| ***A61H 15/00*** | (2006.01) |

(52) U.S. Cl.

CPC ..... *A61H 39/00* (2013.01); *A61H 7/004* (2013.01); *A61H 15/0078* (2013.01);
(Continued)

(58) Field of Classification Search

CPC ..... A61H 1/00–1/008; A61H 7/004; A61H 2007/009; A61H 15/00–15/0078;
(Continued)

(56) References Cited

U.S. PATENT DOCUMENTS 4,011,862 A * 3/1977 Kosiak ..... A61H 15/0078 601/112
5,020,518 A * 6/1991 Spears ..... A61H 15/0078 601/102

(Continued)

FOREIGN PATENT DOCUMENTS

JP 05-020732 3/1993
KR 20-0219420 4/2001

(Continued)

OTHER PUBLICATIONS

WO patent application No. PCT/KR2012/010438, International Search Report dated Feb. 27, 2013.

(Continued)

*Primary Examiner* — Rachel T Sippel
(74) *Attorney, Agent, or Firm* — John H. Choi & Associates LLC

(57) ABSTRACT

A massage apparatus in which a plurality of acupressure assemblies apply acupressure to the human body in close contact with the human body and move individually or in connection with each other, thereby inducing a user's joints to exercise. According to an aspect of the present invention, there is provided a massage apparatus including a support frame and one or more acupressure assemblies, each of which includes one or more acupressure members rotated directly by power and is supported by the support frame, wherein the acupressure assemblies rotate in one direction around one axis of the support frame.

17 Claims, 29 Drawing Sheets

(52) U.S. Cl.
CPC ..... *A61H 39/04* (2013.01); *A61H 2015/0014* (2013.01); *A61H 2201/0149* (2013.01); *A61H 2201/1215* (2013.01); *A61H 2201/1666* (2013.01); *A61H 2201/1671* (2013.01); *A61H 2201/1695* (2013.01); *A61H 2201/5035* (2013.01); *A61H 2201/5038* (2013.01); *A61H 2201/5046* (2013.01); *A61H 2201/5097* (2013.01)

(58) Field of Classification Search
CPC ... A61H 2015/0007–2015/0071; A61H 39/00; A61H 39/02; A61H 39/04; A61H 2201/0138–2201/0149; A61H 2201/12–2201/1246; A61H 2201/1664–2201/1678; A61H 2201/5051–2201/5056; A61H 2203/0425–2203/0462
See application file for complete search history.

(56) References Cited

U.S. PATENT DOCUMENTS

2003/0171702 A1* 9/2003 Thompson ..... A45D 33/02 601/72
2004/0225240 A1* 11/2004 Kim ..... A61H 15/0078 601/99
2005/0192520 A1* 9/2005 Morita ..... A61H 7/00 601/99
2010/0049106 A1* 2/2010 Gueret ..... A45D 34/041 601/112
2010/0286569 A1* 11/2010 Nagano ..... A61H 1/008 600/587
2011/0009783 A1* 1/2011 Dverin ..... A61B 18/14 601/137
2011/0275968 A1* 11/2011 Liu ..... A61H 7/007 601/134
2012/0245496 A1* 9/2012 Ishikawa ..... A61H 7/007 601/98

FOREIGN PATENT DOCUMENTS

KR 10-0494036 6/2005
KR 10-1070059 10/2011

OTHER PUBLICATIONS

JP patent publication No. 05-020732, English translation of abstract.
KR patent publication No. 20-0219420, English translation of abstract.

* cited by examiner

MASSAGING MACHINE

TECHNICAL FIELD

The present invention relates to a massage apparatus, and more particularly, to a massage apparatus in which a plurality of acupressure assemblies apply acupressure to the human body in close contact with the human body and move individually or in connection with each other, thereby inducing a user's joints to exercise.

BACKGROUND ART

The advancement of medical technology and the increased interest in individual health are accelerating an aging phenomenon in which the elderly occupy an increasing proportion of the total population. However, the aging phenomenon does not mean that all of the elderly are healthy.

In particular, with the development of science and technology, jobs once done manually by humans are now being carried out automatically. Therefore, more and more people are spending most of their day in a certain posture without moving much.

For this reason, although body proportions of people seem to have improved from the past, the inside of their body has not in many cases. That is, continuous exercise enables each organ of the human body to function properly. However, the number of people having organs failing to function properly is increasing due to a lack of exercise. In addition, people with such problems are not limited to the elderly, and the age group having diseases due to a lack of exercise is gradually becoming younger.

As tools for relieving strained muscles, a chair-shaped massager, a portable massager, etc. have been introduced. However, these massagers massage muscles of the human body but do not exercise joints.

Therefore, it is required to come up with an invention that cannot only apply acupressure to the human body but also easily exercise joints.

DISCLOSURE

Technical Problem

Aspects of the present invention provide a massage apparatus in which a plurality of acupressure assemblies apply acupressure to the human body in close contact with the human body and move individually or in connection with each other, thereby inducing a user's joints to exercise.

However, aspects of the present invention are not restricted to the one set forth herein. The above and other aspects of the present invention will become more apparent to one of ordinary skill in the art to which the present invention pertains by referencing the detailed description of the present invention given below.

Technical Solution

According to an aspect of the present invention, there is provided a massage apparatus comprising: a support frame; and one or more acupressure assemblies, each of which comprises one or more acupressure members rotated by power and is supported by the support frame, wherein the acupressure assemblies rotate in one direction around one axis of the support frame.

Advantageous Effects

In a massage apparatus according to the present invention, a plurality of acupressure assemblies apply acupressure to the human body in close contact with the human body and move individually or in connection with each other, thereby inducing a user's joints to exercise. Therefore, the user can exercise his or her joints without special efforts while getting acupressure therapy.

However, the effects of the present invention are not restricted to the one set forth herein. The above and other effects of the present invention will become more apparent to one of daily skill in the art to which the present invention pertains by referencing the claims.

DESCRIPTION OF DRAWINGS

The above and other aspects and features of the present invention will become more apparent by describing in detail exemplary embodiments thereof with reference to the attached drawings, in which.

BEST MODE

The present invention will now be described more fully with reference to the accompanying drawings, in which exemplary embodiments of the invention are shown.

Figure 1:
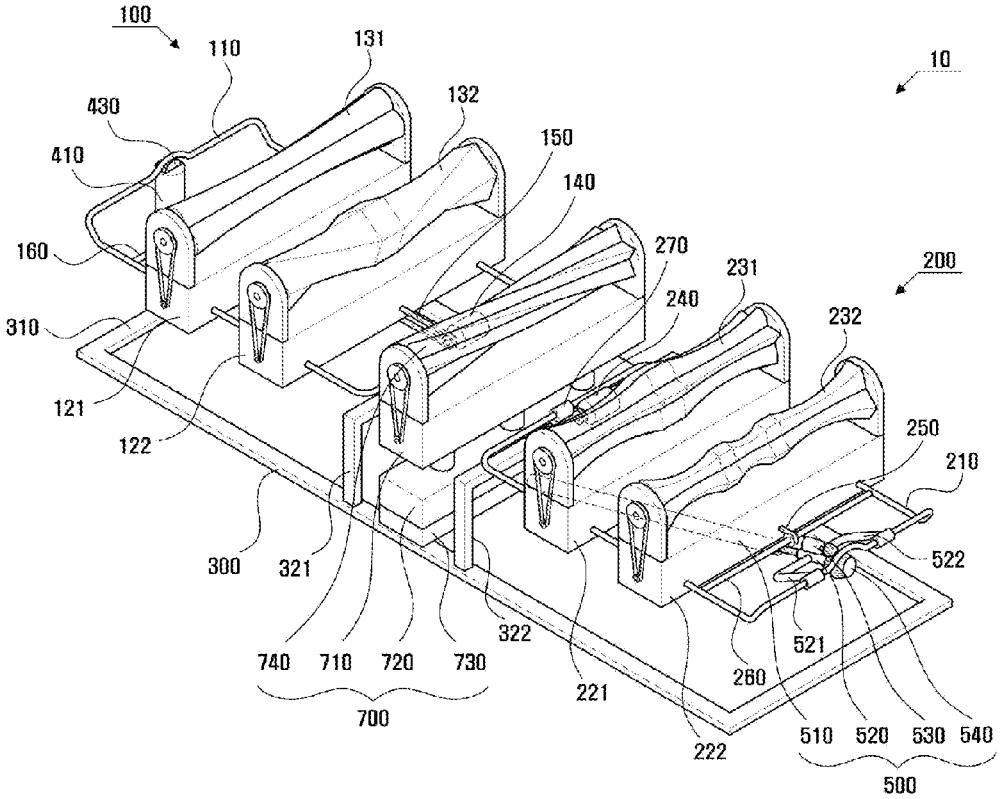
FIG. 1 illustrates a massage apparatus according to an embodiment of the present invention.

FIG. 1 illustrates a massage apparatus 10 according to an embodiment of the present invention. The massage apparatus 10 includes a support frame 300, acupressure assemblies 100 and 200, and an auxiliary acupressure assembly 700.

The support frame 300 supports the acupressure assemblies 100 and 200 and the auxiliary acupressure assembly 700.

The support frame 300 includes a horizontal frame 310 which is closely attached to the ground to form a virtual horizontal plane and vertical frames 321 and 322 which support the acupressure assemblies 100 and 200 and the auxiliary acupressure assembly 700. The horizontal frame 310 may be securely coupled to the vertical frames 321 and 322.

In FIG. 1, the horizontal frame 310 has a quadrilateral shape. However, the horizontal frame 310 may also have a polygonal shape (such as a triangle or a pentagon) or a circular shape. The horizontal frame 310 may further include legs that contact the ground.

Each of the acupressure assemblies 100 and 200 includes one or more acupressure members 131 and 132 or 231 and 232 rotated by power and is supported by the vertical frame 321 or 322 of the support frame 300. Each of the acupressure assemblies 100 and 200 includes acupressure supports 121 and 122 or 221 and 222 which support the acupressure members 131 and 132 or 231 and 232 and an acupressure frame 110 or 210 which supports the acupressure supports 121 and 122 or 221 and 222.

Figure 2:
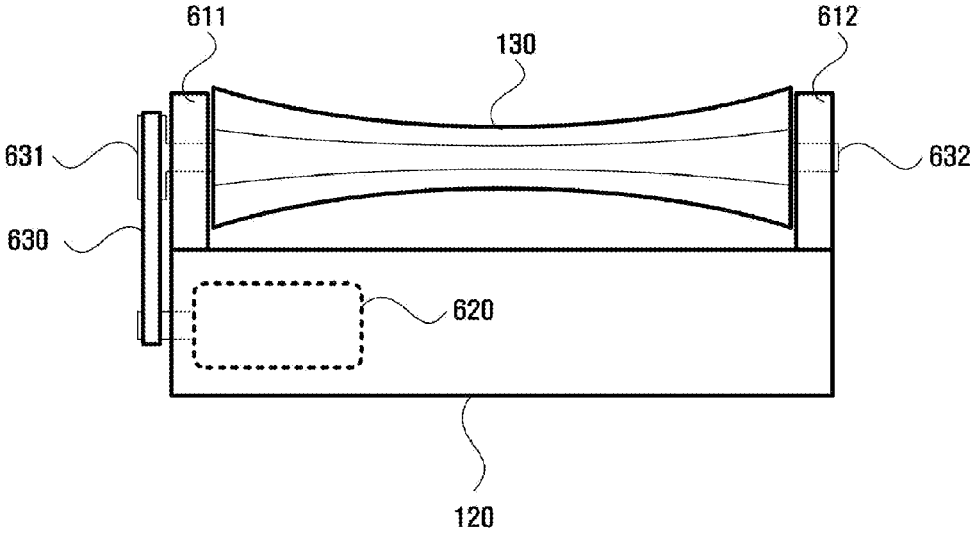
FIG. 2 illustrates the connection structure of an acupressure member and an acupressure support according to an embodiment of the present invention.

FIG. 2 illustrates the connection structure of an acupressure member and an acupressure support according to an embodiment of the present invention.

Referring to FIG. 2, spindles 631 and 632 at both ends of an acupressure member 130 are supported by acupressure member support units 611 and 612, and a power unit 620 is included in an acupressure support 120. The acupressure member 130 connected to the power unit 620 by a belt 630 is rotated by a rotational force of the power unit 620.

An acupressure support may make a reciprocating motion along a specific path on an acupressure frame.

Figure 3:
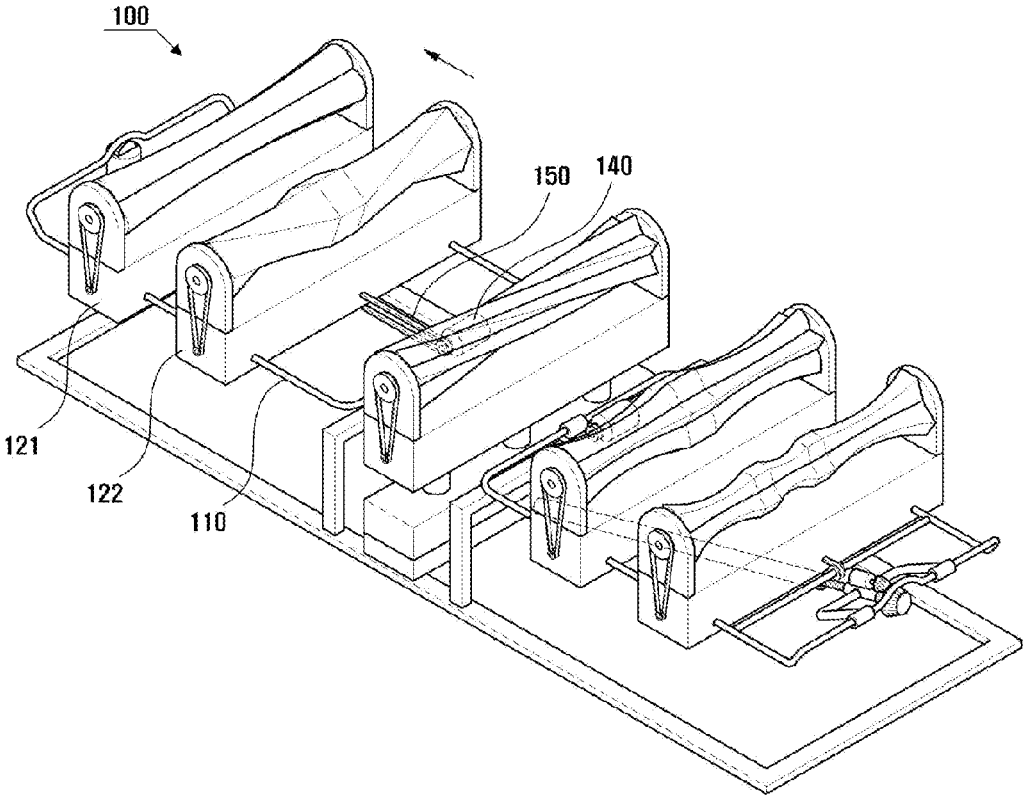
FIGS. 3 and 4 illustrate horizontal motions of acupressure supports according to an embodiment of the present invention.
Figure 4:
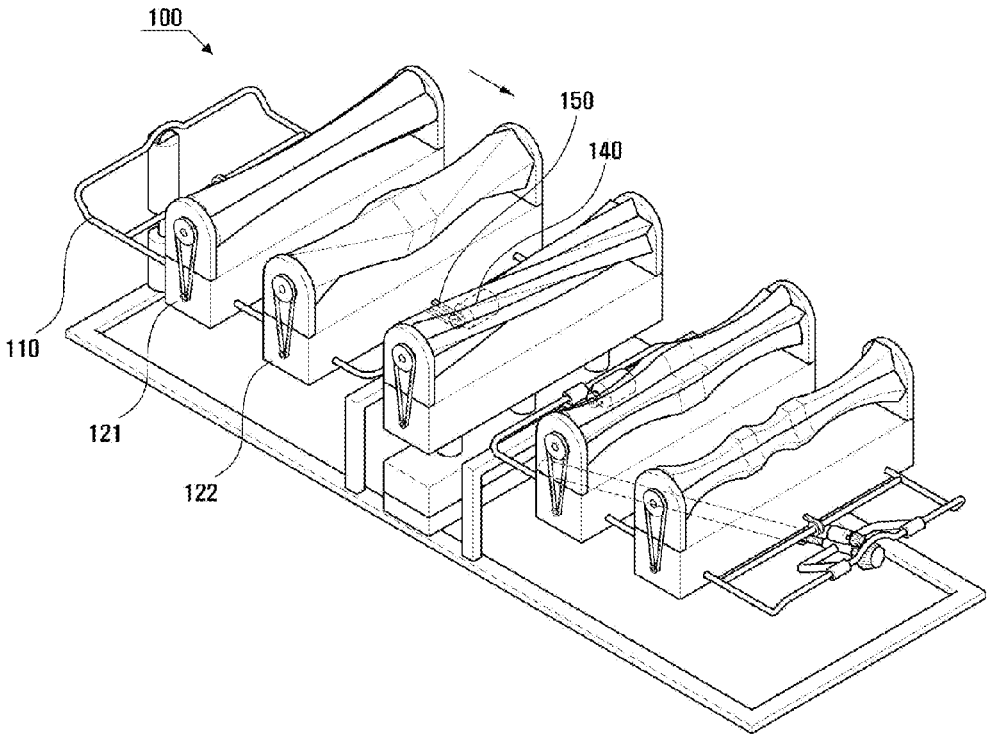

FIGS. 3 and 4 illustrate horizontal motions of the acupressure supports 121 and 122 according to an embodiment of the present invention. Referring to FIGS. 3 and 4, the acupressure frame 110 passes through both ends of each of the acupressure supports 121 and 122. Accordingly, both bars of the acupressure frame 110 passing through the acupressure supports 121 and 122 provide a path for the reciprocating motion of the acupressure supports 121 and 122.

The reciprocating motion of the acupressure supports 121 and 122 is carried out by a power unit 140 attached to the acupressure frame 110. The power unit 140 and the acupressure supports 121 and 122 are connected by a moving chain 150, and part of the moving chain 150 is coupled to the acupressure supports 121 and 122. Accordingly, as the rotational direction of the power unit 140 changes, the horizontal motion of the acupressure supports 121 and 122 is realized.

To this end, a chain fixing unit 160 may be provided on a side of the acupressure frame 110 which is opposite the power unit 140. The moving chain 150 is ring-shaped and has a side connected to the power unit 140. A rotational force provided by the power unit 140 rotates the moving chain 150. Here, since part of the moving chain 150 is connected to the acupressure supports 121 and 122, the rotation of the moving chain 150 may result in the horizontal motion of the acupressure supports 121 and 122.

The chain fixing unit 160 is used to switch the direction of a force applied to the acupressure supports 121 and 122.

In FIGS. 3 and 4, the reciprocating motion of the acupressure supports 121 and 122 included in the left acupressure assembly 100 is illustrated. However, the acupressure supports 221 and 222 included in the right acupressure assembly 200 may also make a reciprocating motion in a similar way to the acupressure supports 121 and 122.

In FIGS. 1, 3 and 4, the power units 140 and 240 in the form of motors, the moving chains 150 and 250, and the chain fixing units 160 and 260 are used to generate a force for the reciprocating motion of the acupressure supports 121, 122, 221 and 222. However, the present invention is not limited thereto, and a unit using an attractive force or a repulsive force generated by an electric force or a magnetic force, a unit using a hydraulic force, or a unit using a rotational force of a screw can also be used.

In the present invention, the acupressure assemblies 100 and 200 may rotate in one direction around one axis of the support frame 300. To this end, rotary power units 400 and 500 may be installed. In the present invention, the rotary power units 400 and 500 may perform their functions in two forms. The rotary power units 400 and 500 in different forms will hereinafter be referred to as a first rotary power unit 400 and a second rotary power unit 500.

Figure 7:
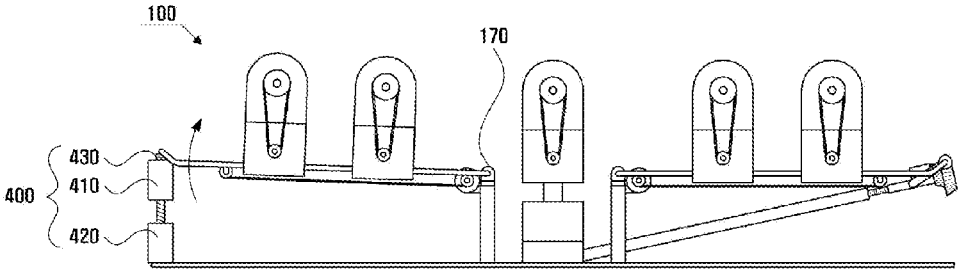
Figure 8:
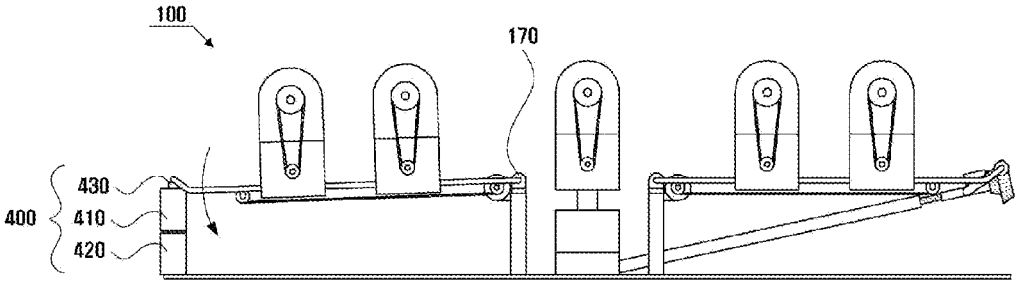

Referring to FIGS. 7 and 8, the first rotary power unit 400 may include a first power part 410 and a second power part 420. The first power part 410 consists of a gear 430 and a motor (not shown) that provides a rotational force to the gear 430, and the second power part 420 provides a pushing force or a pulling force to the first power part 410.

A screw thread may be provided on a side of the acupressure frame 110. As the screw thread engages with the gear 430 of the first power part 410, the gear 430 rotates, thereby moving the acupressure assembly 100. The other side of the acupressure frame 110 without the screw thread is connected to the vertical frame 321 by a connecting unit 170, and the acupressure assembly 100 rotates around the connecting unit 170.

Figure 5:
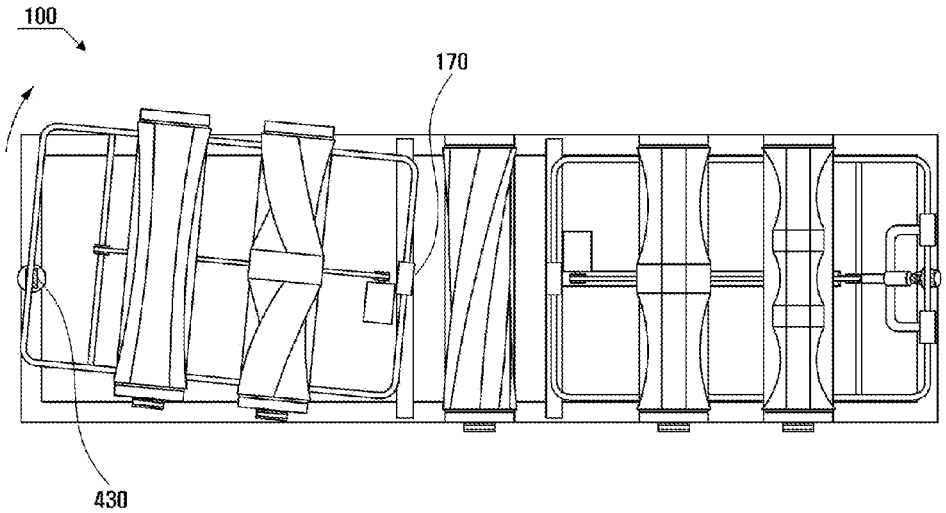
FIGS. 5 through 10 illustrate rotary motions of acupressure assemblies on a support frame according to an embodiment of the present invention.
Figure 6:
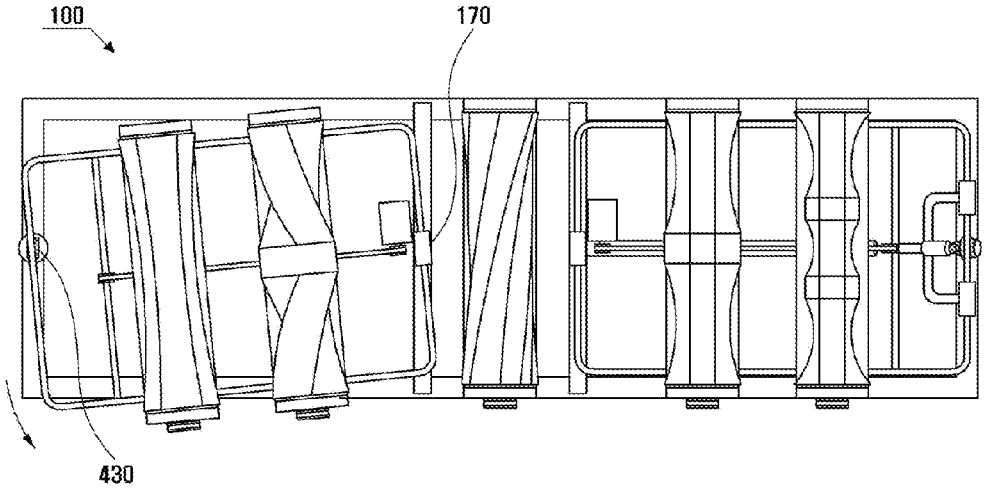

In other words, the acupressure assembly 100 moves to the left or to right in an arc motion around an axis, e.g., a virtual straight line that passes through the connecting unit 170 in a direction perpendicular to the ground, as illustrated in FIGS. 5 and 6. The arc motion of the acupressure assembly 100 around the virtual straight line perpendicular to the ground will hereinafter be referred to as a first rotary motion.

In addition, a side of the acupressure frame 110 is connected to the vertical frame 321 by the connecting unit 170. Thus, as the first power part 410 moves in a reciprocating motion with respect to the second power part 420, the acupressure frame 110 rotates around the connecting unit 170.

That is, when the second power part 420 applies a pushing force or a pulling force to the first power part 410, the gear 430 provided on a side of the first power part 410 pushes up the acupressure assembly 100 by contacting the screw thread of the acupressure frame 110, or the first power part 410 is pushed by the weight of the acupressure assembly 100. Accordingly, the acupressure assembly 100 moves up and down in an arc motion using a virtual horizontal line formed in the connecting unit 170 as an axis. The acupressure assembly 100 that has been pushed up is illustrated in FIG. 7.

For the vertical movement of the acupressure assembly 100 in an arc motion, a side of the first power part 410 may be inserted into the second power part 420. As the side of the first power part 410 is inserted into the second power part 420, an outer surface of the first power part 410 and an inner surface of the second power part 420 contact each other, thereby providing a path for the reciprocating motion of the first power part 410.

FIGS. 7 and 8 illustrate the reciprocating motion of the first power part 410 with respect to the second power part 420. The reciprocating motion of the first power part 410 is performed as a side of the first power part 410 having a step difference is inserted into or removed from the second power part 420.

The second power part 420 may provide a pushing force or a pulling force to the first power part 410 using an attractive force or a repulsive force generated by an electric force or a magnetic force, a hydraulic force, or a rotational force of a screw, or may use a rotational force of a screw.

Here, the rotational force of the screw may be used as follows. A motor is provided inside the second power part 420, and a screw hole member having a screw hole is attached to the motor and rotated by a rotational force of the motor. In addition, a side of the first power part 410 which can be inserted into the second power part 420 may have a screw thread. As the screw thread is coupled to the screw hole of the second power part 420, the screw hole member rotates, thereby moving the first power part 410 in a reciprocating motion.

A case where a side of the first power part 410 is inserted into the second power part 420 has been described above. However, the present invention is not limited to this case, and a side of the second power part 420 can also be inserted into the first power part 410. In this case, a screw thread may be formed at the side of the second power part 420, and a screw hole member and a motor which drives the screw hole member may be provided in the first power part 410.

Alternatively, a screw hole may be provided in the first power part 410, and a screw thread member having a screw thread and a motor may be provided in the second power part 420. As the screw thread member rotates, the first power part 410 may make a reciprocating motion.

The arc motion of the acupressure frame 110 around the virtual horizontal line will hereinafter be referred to as a second rotary motion.

The second rotary power unit 500 includes a main bar 510, an auxiliary bar 520, a driving gear 540 provided at an end of the auxiliary bar 520, and a motor 530 providing a rotational force to the driving gear 540.

As described above, a screw thread may be provided on a side of the acupressure frame 210. As the screw thread engages with the driving gear 540 of the second rotary power unit 500, the driving gear 540 rotates, thereby moving the acupressure assembly 200. The other side of the acupressure frame 210 without the screw thread is connected to the vertical frame 322 by a connecting unit 270, and the acupressure assembly 200 rotates around the connecting unit 270. This has been described above in detail and thus will not be described again.

Like the first power part 410 making a reciprocating motion with respect to the second power part 420 of the first rotary power unit 400, the auxiliary bar 520 of the second rotary power unit 500 may make a similar reciprocating motion with respect to the main bar 510 of the second rotary power unit 500.

That is, the main bar 510 may provide a pushing force or a pulling force to the auxiliary bar 520 using an attractive force or a repulsive force generated by an electric force or a magnetic force, a hydraulic force, or a rotational force of a screw, or may use a rotational force of a screw.

However, while the reciprocating motion of the first power part 410 with respect to the second power part 420 of the first rotary power unit 400 is perpendicular to the ground, the reciprocating motion of the auxiliary bar 520 with respect to the main bar 510 of the second rotary power unit 500 may be oblique to the ground.

In FIGS. 1 and 3 through 10, an end of the main bar 510 is connected to the auxiliary acupressure assembly 700. Since the main bar 510, unlike the second power part 420, is not connected to the horizontal frame 310, the reciprocating motion of the auxiliary bar 520 with respect to the main bar 510 is oblique to the ground.

Figure 9:
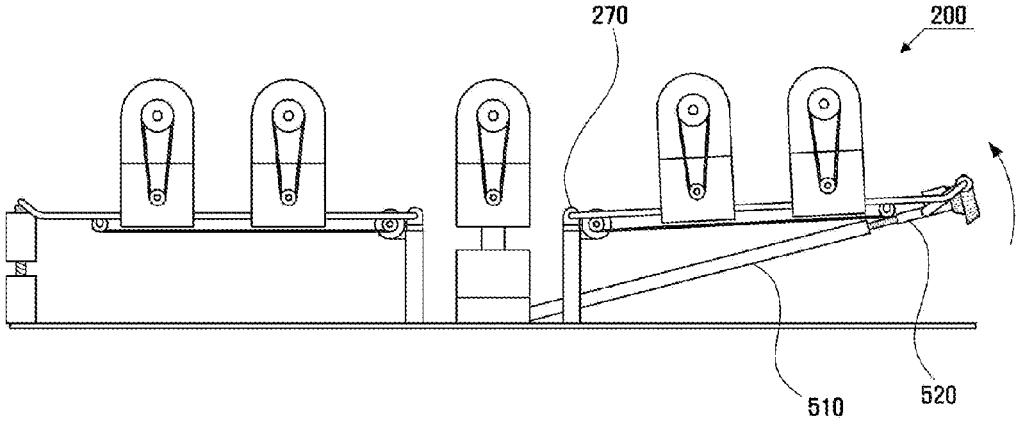
Figure 10:
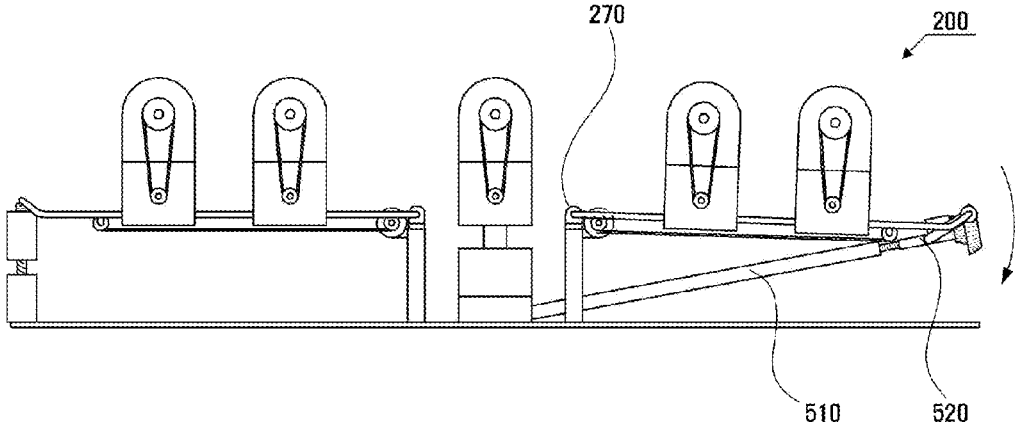

However, although the reciprocating motion of the auxiliary bar 520 with respect to the main bar 510 is oblique to the ground, since the acupressure frame 210 is fixed in position by the connecting unit 270, the acupressure assembly 200 rotates up and down around the connecting unit 270, as illustrated in FIGS. 9 and 10.

That is, respective ends of 'L'-shaped coupling batons 521 and 522 of the auxiliary bar 520 are shaped like cylinders, and the acupressure frame 210 passes through the cylinders. Even if the reciprocating motion of the auxiliary bar 520 is oblique to the ground, a force that the coupling batons 521 and 522 act on the acupressure frame 210 is created only in a vertical direction by the connecting unit 270.

In FIGS. 1 and 3 through 10, an end of the main bar 510 is connected to the auxiliary acupressure assembly 700. However, the end of the main bar 510 may be located at various positions. In addition, the coupling batons 521 and 522 of the auxiliary bar 520 may also be provided in the first power part 410.

In FIGS. 1 and 3 through 10, one 110 of the two acupressure frames 110 and 210 is connected to the first rotary power unit 400, and the other one 210 of the two acupressure frames 110 and 210 is connected to the second rotary power unit 500. However, all of the acupressure frames 110 and 210 may also be connected to the first rotary power unit 400 or the second rotary power unit 500.

Figure 11:
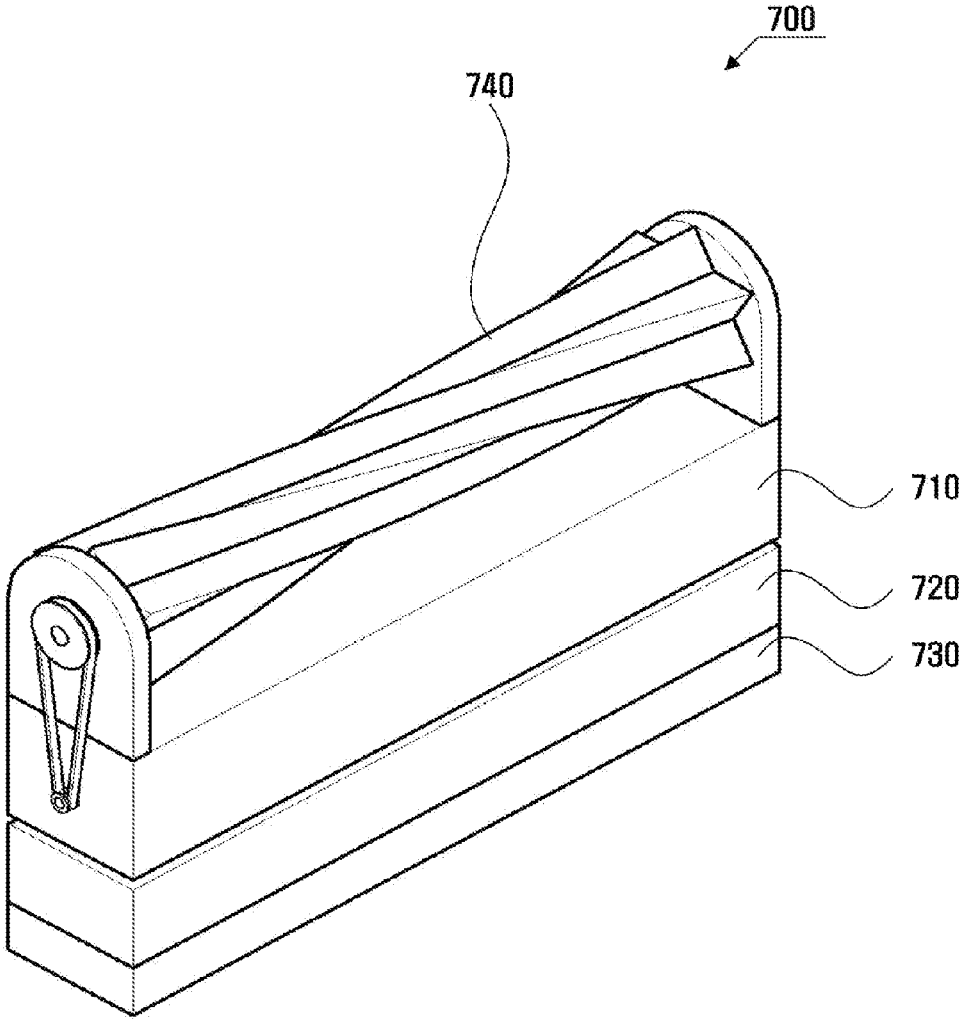
FIG. 11 illustrates the detailed structure of an auxiliary acupressure assembly according to an embodiment of the present invention.

FIG. 11 illustrates the detailed structure of the auxiliary acupressure assembly 700 according to an embodiment of the present invention. Referring to FIG. 11, the auxiliary acupressure assembly 700 includes an auxiliary acupressure support 710, a slide unit 720, a fixing unit 730, and an auxiliary acupressure member 740.

The fixing unit 730 is coupled to the support frame 300 and supports the slide unit 720.

The slide unit 720 slides within a predetermined range in close contact with the fixing unit 730. That is, the slide unit 720 makes a horizontal reciprocating motion with respect to the ground. To this end, the slide unit 720 or the fixing unit 730 may include a power unit (not shown) which generates a force for reciprocating motion.

The auxiliary acupressure support 710 supports the auxiliary acupressure member 740. In this state, the auxiliary acupressure support 710 makes a reciprocating motion in a direction perpendicular to a sliding direction of the slide unit 720. That is, the auxiliary acupressure support 710 can be pushed up or returned to its original position with respect to the slide unit 720. The principle of the reciprocating motion of the auxiliary acupressure support 710 can be understood as being similar to the principle of the reciprocating motion of the first power part 410 caused by a force provided by the second power part 420 of the first rotary power unit 400.

That is, in a structure in which a portion of the auxiliary acupressure support 710 is inserted into the slide unit 720 or in a structure in which a portion of the slide unit 720 is inserted into the auxiliary acupressure support 710, the slide unit 720 or the auxiliary acupressure support 710 provides a pushing force or a pulling force to the auxiliary acupressure support 710 or the slide unit 720 using an attractive force or a repulsive force generated by an electric force or a magnetic force, a hydraulic force, or a rotational force of a screw.

Figure 12:
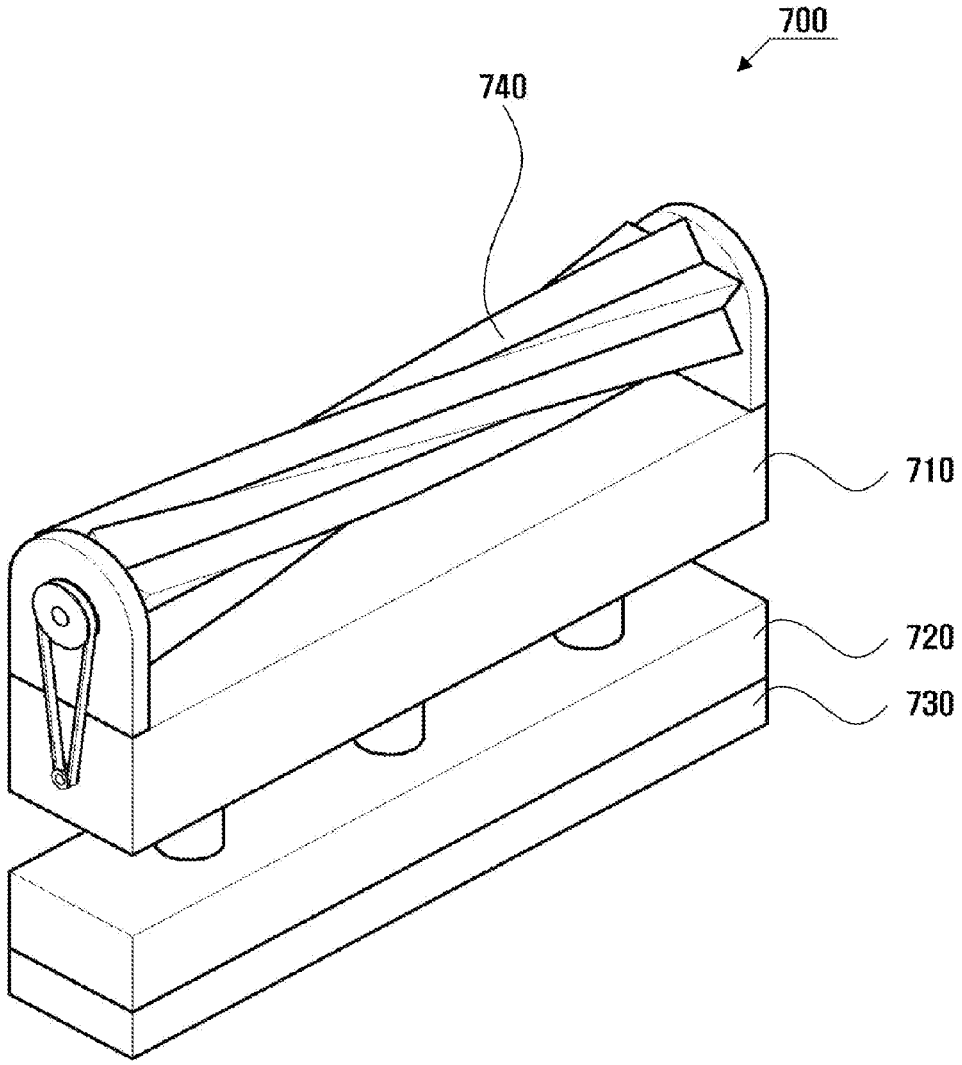
FIG. 12 illustrates the movement of an auxiliary acupressure support included in the auxiliary acupressure assembly.
Figure 13:
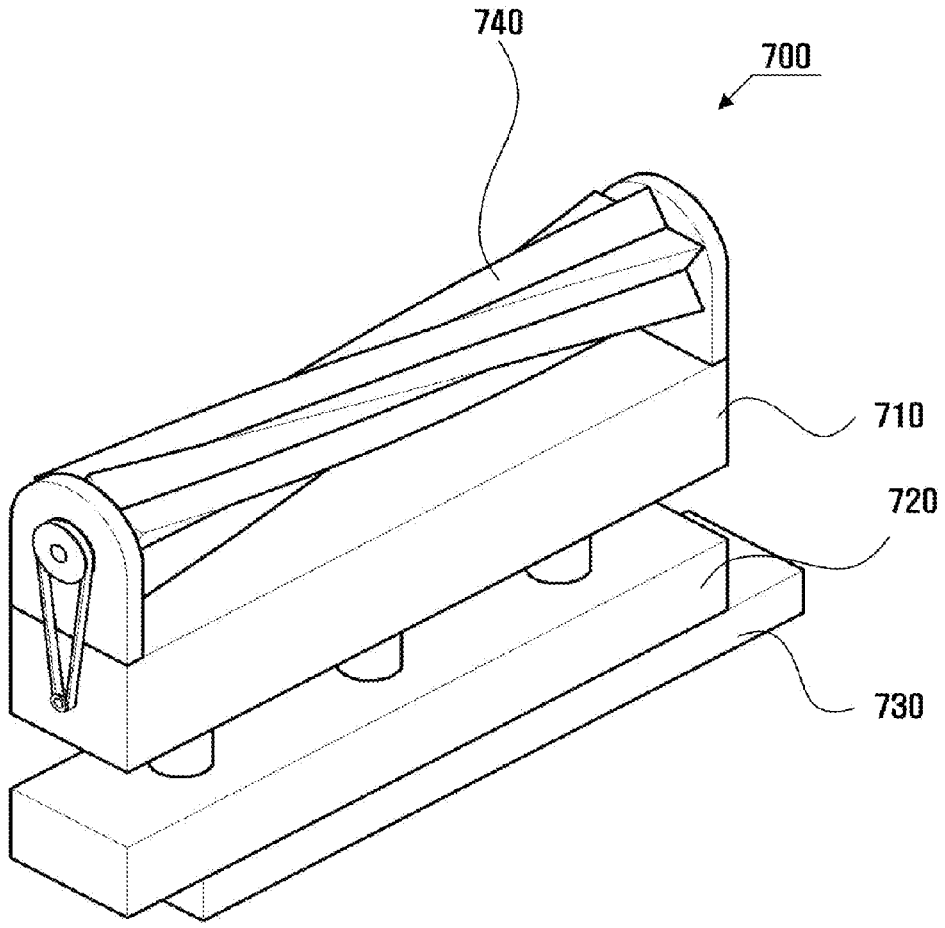
FIGS. 13 and 14 illustrate the movement of a slide unit included in the auxiliary acupressure assembly.
Figure 14:
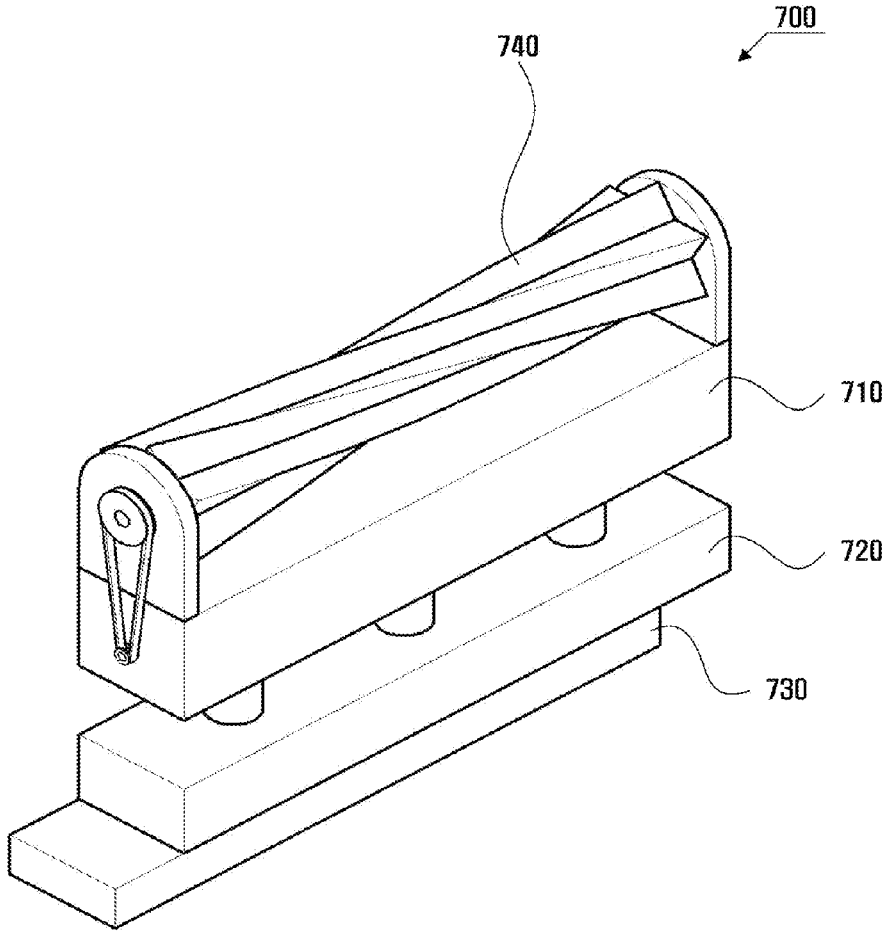

FIGS. 12 through 14 illustrate the operation of the auxiliary acupressure assembly 700 according to an embodiment of the present invention. Specifically, FIG. 12 illustrates the movement of the auxiliary acupressure support 710 included in the auxiliary acupressure assembly 700, and FIGS. 13 and 14 illustrate the movement of the slide unit 720 included in the auxiliary acupressure assembly 700.

Figure 15:
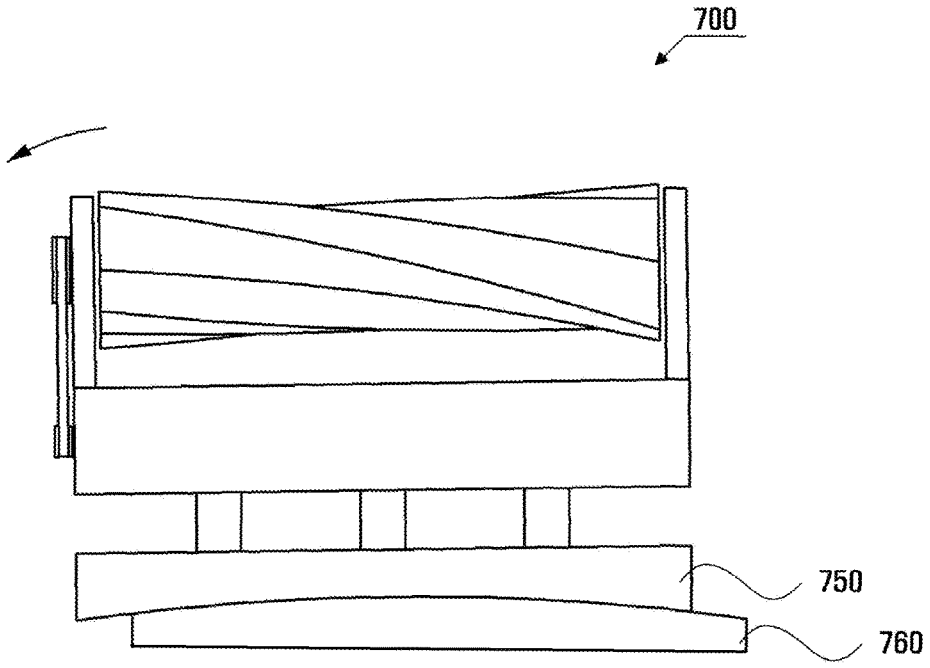
FIGS. 15 and 16 illustrate the movement of a slide unit included in an auxiliary acupressure assembly according to another embodiment of the present invention.
Figure 16:
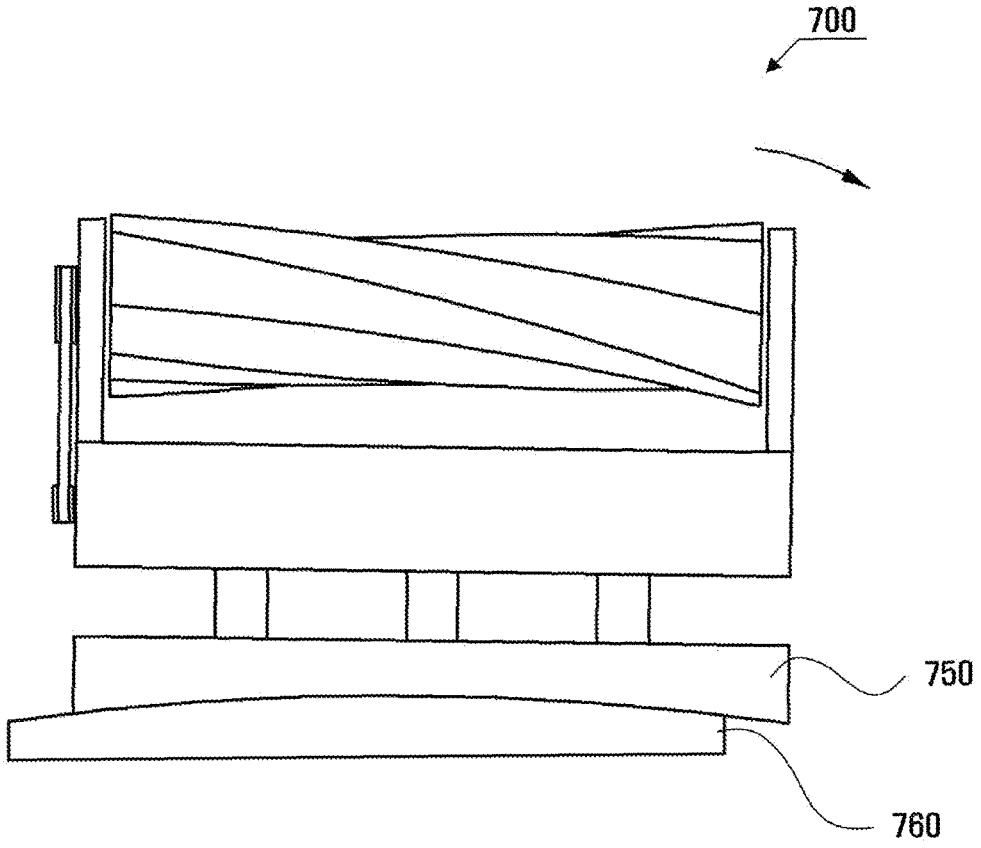

Referring to FIGS. 15 and 16, a contact surface between a fixing unit 760 and a slide unit 750 may be curved. Accordingly, the slide unit 750 moves in a convex circular motion with respect to the ground. The circular motion of the slide unit 750 with respect to the ground can further improve the effect of massaging a part of the body resting on the auxiliary acupressure assembly 700.

In FIGS. 1 and 3 through 16, one auxiliary acupressure assembly 700 is illustrated. However, a plurality of auxiliary acupressure assemblies 700 can also be provided.

Figure 17:
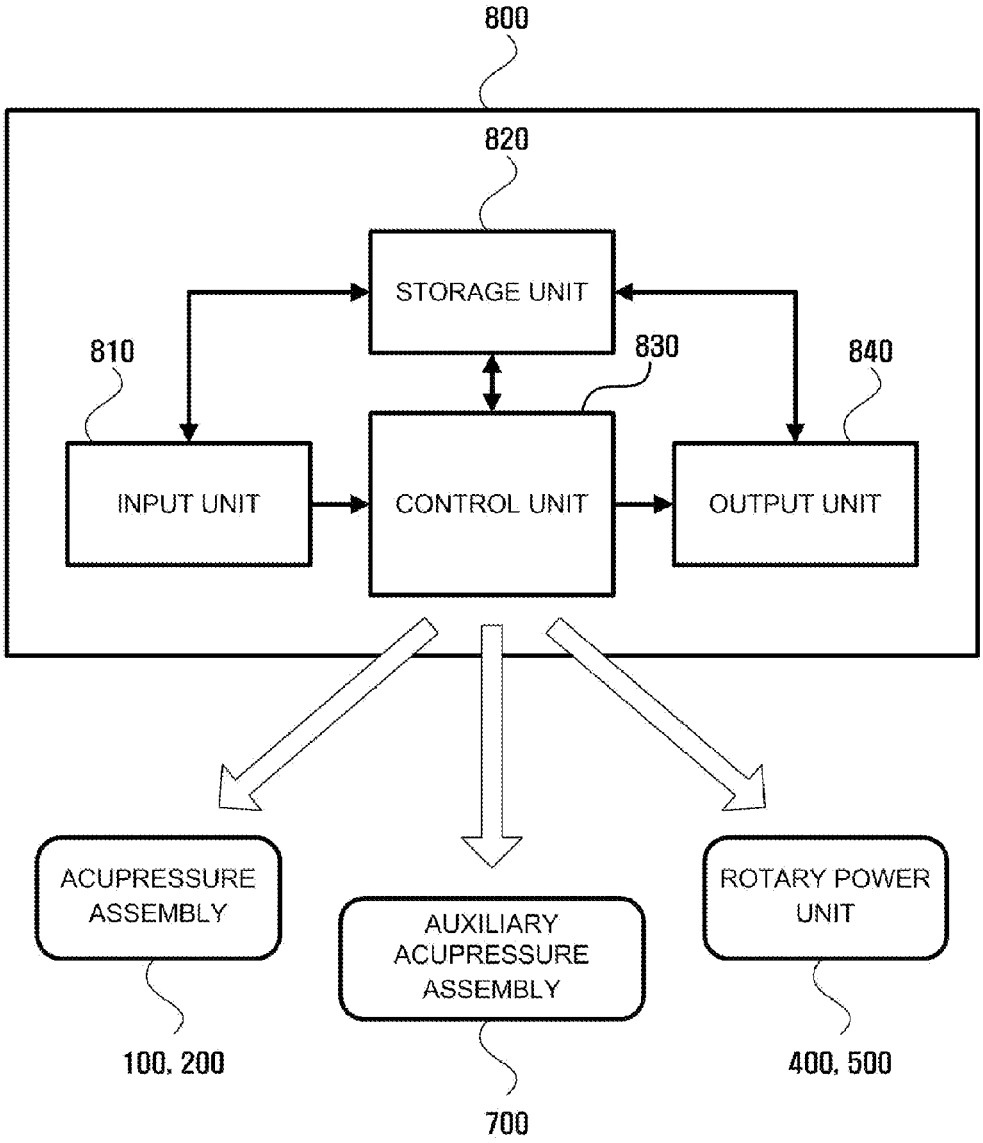
FIG. 17 is a block diagram of a user control module according to an embodiment of the present invention.

FIG. 17 is a block diagram of a user control module 800 according to an embodiment of the present invention. Referring to FIG. 17, the user control module 800 includes an input unit 810, a storage unit 820, a control unit 830, and an output unit 840.

The input unit 810 includes buttons, a wheel, a jog shuttle, etc. to receive a command from a user. In addition, the massage apparatus 10 includes a display unit as the output unit 840. If the display unit provides a touchscreen function, it may also serve as the input unit 810.

The input unit 810 itself can be a device. For example, a wireless remote control may serve as the input unit 810. That is, a user can input a command using buttons, a wheel, etc. provided on the wireless remote control. If the wireless remote control includes an inertial sensor, the user may move the wireless remote control, thereby inputting information corresponding to the trajectory of the movement.

A user can control the movement of the acupressure assemblies 100 and 200 and the auxiliary acupressure assembly 700 using the input unit 810. That is, the user can control the rotational speed or rotational pattern of the acupressure members 131, 132, 231 and 232 and the auxiliary acupressure member 740 and the rotary motion or reciprocating motion of the acupressure assemblies 100 and 200 and the auxiliary acupressure assembly 700 by inputting commands using the input unit 810.

In the massage apparatus 10 of the present invention, the acupressure assemblies 100 and 200 and the auxiliary acupressure assembly 700 may operate individually or in connection with each other.

Here, when each assembly operates individually, it means that each assembly operates independently without being affected by the operation pattern of another assembly. For example, when the acupressure assemblies 100 and 200 rotate while the auxiliary acupressure assembly 700 moves horizontally, the rotational speed and pattern of the acupressure assemblies 100 and 200 are not affected at all by the speed or pattern of the horizontal motion of the auxiliary acupressure assembly 700.

On the other hand, when each assembly operates in connection with another assembly, it means that the operation pattern of each assembly is affected by the operation pattern of another assembly. For example, after the first acupressure assembly 100 rotates once, the auxiliary acupressure assembly 700 moves horizontally twice. Next, the second acupressure assembly 200 rotates twice, and then the auxiliary acupressure assembly 700 moves horizontally once. After the horizontal motion of the auxiliary acupressure assembly 700, the whole process is repeated from the beginning. Thus, the first acupressure assembly 100 rotates once again.

As described above, the acupressure assemblies 100 and 200 of the present invention perform the first rotary motion and the second rotary motion. The first rotary motion and the second rotary motion can be performed individually or simultaneously. That is, the second rotary motion can be performed as the same time as the first rotary motion.

In addition, the auxiliary acupressure assembly 700 can perform a horizontal motion and a vertical motion simultaneously.

Accordingly, the acupressure assemblies 100 and 200 and the auxiliary acupressure assembly 700 can operate in various patterns, and a force can also be applied in various patterns to a user's body resting on the acupressure assemblies 100 and 200 and the auxiliary acupressure assembly 700.

The acupressure assemblies 100 and 200 and the auxiliary acupressure assembly 700 can apply various forces ranging simply from acupressure applied by the acupressure members 131, 132, 231 and 232 to the pushing and twisting of the body by the rotary and reciprocating motions of the acupressure frames 110 and 210 or the auxiliary acupressure assembly 700. In addition, the movement of the acupressure frames 110 and 210 and the auxiliary acupressure assembly 700 may be three-dimensional.

The acupressure assemblies 100 and 200 may move such that the trajectory of an outer end of each of the acupressure assemblies 100 and 200 with respect to the connecting unit 170 or 270 is in the form of a straight line, a curve, a circle, infinity, or a wave. The three-dimensional movement of the acupressure assemblies 100 and 200 and the auxiliary acupressure assembly 700 can bring about the effects of sports massage, Shiatsu massage, Swedish massage, deep tissue massage, and stretching.

Furthermore, the massage apparatus 10 of the present invention can perform an oil massage function by automatically spraying oil. To this end, the massage apparatus 10 may further include a unit (not shown) for spraying oil toward the body of a user. For example, oil may be included inside the acupressure supports 121, 122, 221 and 222 and the auxiliary acupressure support 710, and a path of the oil may be formed in such a way to not disturb the rotation of the acupressure members 131, 132, 231 and 232 and the auxiliary acupressure member 740. In addition, a nozzle may be provided at an end of the oil path, thereby realizing an oil spraying unit. The oil spraying unit can also be provided as a separate device instead of being included in the massage apparatus 10.

Operation patterns of the acupressure assemblies 100 and 200 and the auxiliary acupressure assembly may be set and stored in advance. Alternatively, a user may input and store desired operation patterns of the acupressure assemblies 100 and 200 and the auxiliary acupressure assembly 700.

The operation patterns thus stored may later be implemented when selected by the user. To this end, the storage unit 820 may store the operation patterns of the acupressure assemblies 100 and 200 and the auxiliary acupressure assembly 700.

The storage unit 820 is a module to or from which information can be input or output, such as a hard disk, a flash memory, a compact flash (CF) card, a secure digital (SD) card, smart media (SM) card, a multimedia card (MMC), or a memory stick. The storage unit 820 can be included in the massage apparatus 10 or in a separate device.

The control unit 830 sends a control command to the acupressure assemblies 100 and 200, the auxiliary acupressure assembly 700, and the rotary power units 400 and 5000 according to a user command input through the input unit 810 or an operation pattern stored in the storage unit 820. That is, the control unit 830 controls the motions of the acupressure assemblies 100 and 200 and the auxiliary acupressure assembly 700. Here, the control unit 830 may control individual movements or connected movements of the acupressure assemblies 100 and 200 and the auxiliary acupressure assembly 700.

A support frame of a massage apparatus according to an embodiment of the present invention may consist of a plurality of sub-support frames. In this case, one of the sub-support frames may serve as a base sub-support frame, and the other sub-support frames may rotate in a direction around an axis of the base sub-support frame. The control unit 830 may also control rotary motions of the sub-support frames. Accordingly, the control unit 830 may control individual movements or connected movements of the acupressure assemblies 100 and 200, the auxiliary acupressure assembly 700, and the sub-support frames.

The rotary motions of the sub-support frames will be described in detail later with reference to FIG. 19.

The output unit 840 may provide a user with information about the input status of a user command, the operation state of the massage apparatus 10, etc. This information may be provided in an image form and an audio form. To this end, the output unit 840 may include an image output unit and an audio output unit.

The image output unit is a module including an image display that can display an image signal, such as a cathode ray tube (CRT), a liquid crystal display (LCD), a light-emitting diode (LED), an organic light-emitting diode (OLED) or a plasma display panel (PDP). The image output unit displays the above-described information.

The audio output unit outputs an audio signal. That is, the audio output unit generates waves of condensation and rarefaction in air by converting an electrical signal containing audio information into vibrations of a diaphragm. In so doing, the audio output unit copies sound waves. Generally, the audio output unit may be a speaker.

The user control module 800 may be integrally formed with the massage apparatus 10 or may be implemented as a separate device. If the user control module 800 is implemented as a separate device, a communication unit for communications between the user control module 800 and the massage apparatus 10 may be included in each of the user control module 800 and the massage apparatus 10.

Figure 18:
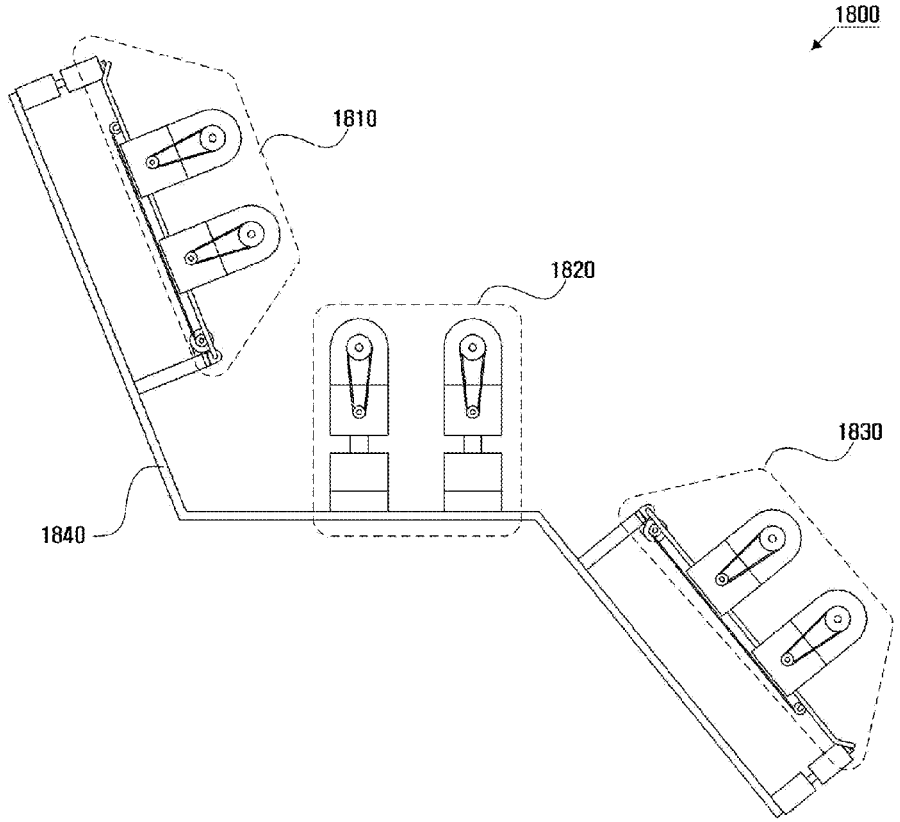
FIG. 18 illustrates a massage apparatus according to another embodiment of the present invention.

FIG. 18 illustrates a massage apparatus 1800 according to another embodiment of the present invention.

The massage apparatus 10 of the previous embodiment is shaped like a bed because all acupressure members 131, 132, 231 and 232 and the auxiliary acupressure member 740 are placed parallel to the ground as illustrated in FIGS. 1 and 3 through 10. However, the present invention is not limited thereto, and the massage apparatus 10 may also be shaped like a chair by making the acupressure members 131, 132, 231 and 232 and the auxiliary acupressure member 740 have different heights from the ground.

FIG. 18 illustrates the chair-shaped massage apparatus 1800. In FIG. 18, acupressure assemblies 1810 and 1830 and an auxiliary acupressure assembly 1820 are attached to a surface of a chair-shaped support frame 1840.

The auxiliary acupressure assembly 1820 illustrated in FIG. 18 includes two auxiliary acupressure members. That is, a plurality of auxiliary acupressure members can be provided in a massage apparatus (10, 1800) as described above.

In the current embodiment, an acupressure assembly does not necessarily include a plurality of acupressure members. That is, an acupressure assembly can also include only one acupressure member. In addition, the numbers and arrangement order of acupressure assemblies and auxiliary acupressure assemblies may be various.

For example, in a state where two acupressure assemblies are placed side by side, an auxiliary acupressure assembly may be placed at an end of the two acupressure assemblies. Alternatively, two auxiliary acupressure assemblies may be placed next to one acupressure assembly, and then two acupressure assemblies may be placed.

Figure 19:
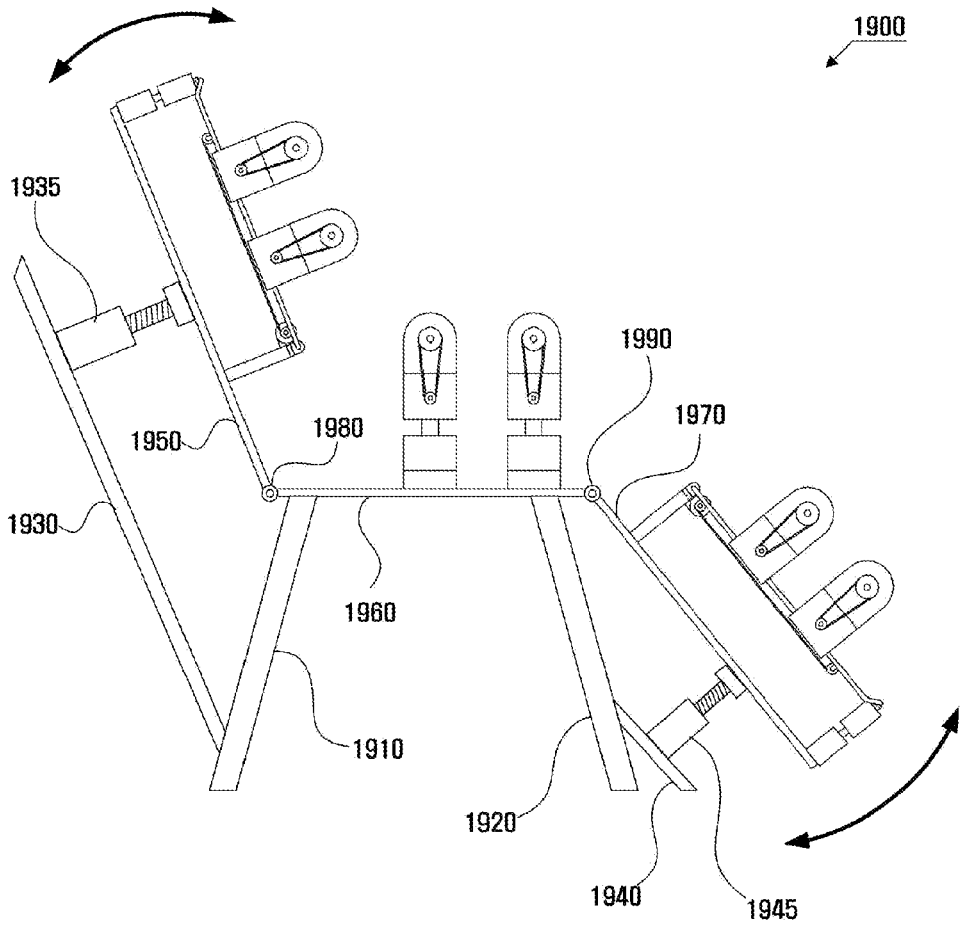
FIG. 19 illustrates a foldable version of a support frame of the massage apparatus of FIG. 18.

FIG. 19 illustrates a foldable version of the support frame 1840 of the massage apparatus 1800 of FIG. 18. A support frame illustrated in FIG. 19 consists of a plurality of sub-support frames. Here, one of the sub-support frames serves as a base sub-support frame, and the other sub-support frames rotate in a direction around an axis of the base sub-support frame.

While the support frame 1840 having a fixed shape is illustrated in FIG. 18, a plurality of support frames, i.e., first through third support frames 1950 through 1970 connected to each other by joints 1980 and 1990 are illustrated in FIG. 19.

Here, legs 1910 and 1920 may be provided under the second support frame 1960 to support the whole of the massage apparatus 1900. Accordingly, the first support frame 1950 and the third support frame 1970 may rotate around the joints 1980 and 1990 with respect to the second support frame 1960.

For the rotary motions of the first support frame 1950 and the third support frame 1970, power units 1935 and 1945 may be provided. The power units 1935 and 1945 may be driven in a manner similar to the reciprocating motion of the first power part 410 with respect to the second power part 420 in the first rotary power unit 400.

As described above, the reciprocating motion of the first power part 410 may be performed as a side of the first power part 410 having a step difference is inserted into or removed from the second power part 420. The second power part 420 may provide a pushing force or a pulling force to the first power part 410 using an attractive force or a repulsive force generated by an electric force or a magnetic force, a hydraulic force, or a rotational force of a screw. The power units 1935 and 1945 illustrated in FIG. 19 may also move in a reciprocating motion similar to the reciprocating motion of the first power part 410. In so doing, the power units 1935 and 1945 may apply a force to the first support frame 1950 and the third support frame 1970, thereby rotating the first support frame 1950 and the third support frame 1970.

To make a pushing force applied by the power units 1935 and 1945 be transmitted to the first support frame 1950 and the third support frame 1970, supports 1930 and 1940 that support the power units 1935 and 1945 may be provided.

The supports 1930 and 1940 may be connected to the legs 1910 and 1920 or may be formed integrally with the legs 1910 and 1920.

[Mode for Invention]

FIGS. 20 through 29 illustrate acupressure members according to embodiments of the present invention.

An acupressure member can have various shapes. In the present invention, an acupressure member and an auxiliary acupressure member have the same shape. Thus, both the acupressure member and the auxiliary acupressure member will hereinafter be referred to as acupressure members.

When a user rests on a massage apparatus 10 according to an embodiment of the present invention, each acupressure member may contact a different part of the user's body. Therefore, each acupressure member of the massage apparatus 10 may have a different shape according to the body part it contacts.

The shape of an acupressure member may be determined by at least one of a thickness pattern formed along a long-axis direction of the acupressure member, a cross-sectional shape, a size of surface protrusions, the number of surface protrusions, a pattern of surface protrusions, and a position pattern of centers of cross sections formed along a long axis with respect to a virtual line connecting centers of cross sections at both ends of the acupressure member.

Here, the thickness pattern formed along the long-axis direction indicates how a diameter of the acupressure member changes along the long-axis direction. For example, the diameter of a cross section of the acupressure member may gradually decrease along the long-axis direction from an end of the acupressure member and then increase toward the other end of the acupressure member, such that the diameters of cross sections of both ends of the acupressure member are equal.

In addition, the cross-sectional shape formed along the long-axis direction indicates how the cross-sectional shape of the acupressure member changes along the long-axis direction. That is, the cross-sectional shape of the present invention may be understood as including at least one of a size of a cross section formed along the long-axis direction, whether or not the cross section rotates, a rotational pattern of the cross section, shapes of protrusions included in the cross section, and the number of protrusions. When only the thickness pattern is taken into consideration, the cross-sectional shape may change only in size along the long-axis direction. However, the cross-sectional shape can also rotate along the long-axis direction, or an entirely different cross-sectional shape can be formed.

Figure 20:
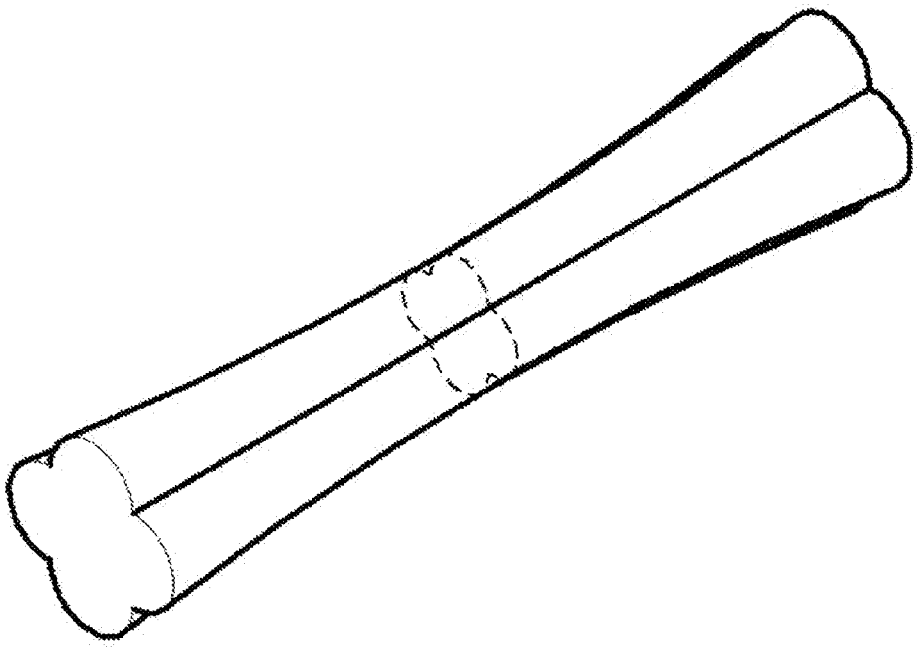
FIGS. 20 through 29 illustrate acupressure members according to embodiments of the present invention.

The acupressure member illustrated in FIG. 20 has a thickness pattern in which the diameter of the acupressure member is largest at both ends and smallest in the middle. In addition, the acupressure member has a cross-sectional shape consisting of four circular protrusions.

Here, the cross-sectional shape of the acupressure member changes only in size along the long-axis direction. That is, the cross-sectional shape is largest at both ends and smallest in the middle.

In FIG. 20, the protrusions are circular. However, protrusions of various shapes such as a triangle, a quadrilateral, etc. can be provided. In addition, various numbers of protrusions, e.g., two, three, or ten protrusions can be provided.

Figure 21:
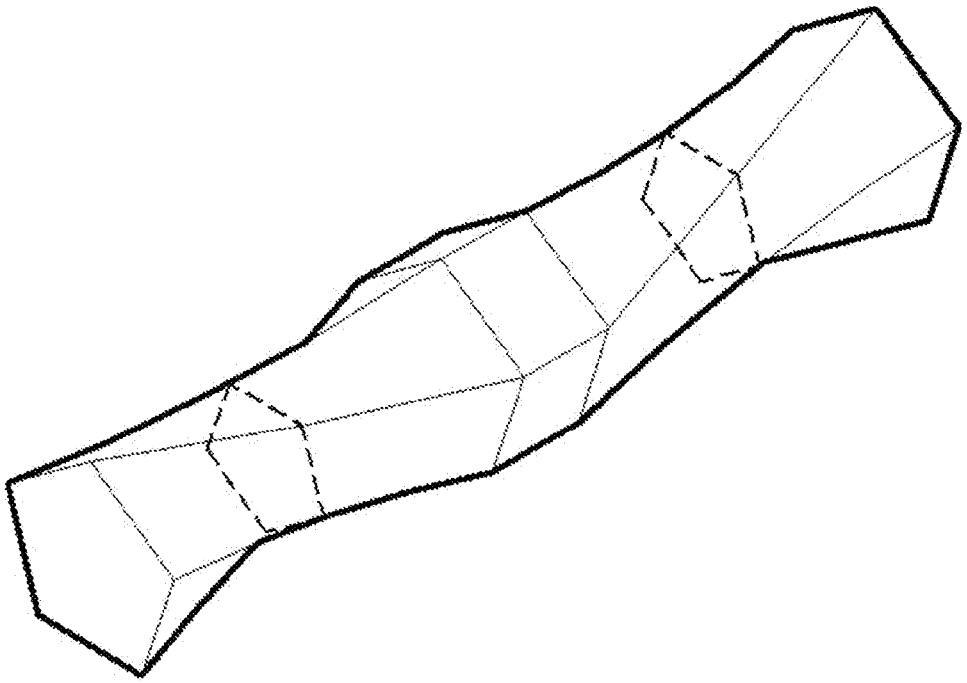

The acupressure member illustrated in FIG. 21 has a thickness pattern in which the diameter of the acupressure member is largest at both ends and in the middle and smallest between the middle and both ends. In addition, the acupressure member does not have protrusions and has a pentagonal cross-sectional shape.

The cross-sectional shape changes in size as it rotates along the long-axis direction. That is, the pentagonal cross section of the acupressure member continuously rotates along the long-axis direction from an end of the acupressure member. Here, the size of the cross section gradually decreases from the end of the acupressure member, increases in the middle, gradually decreases again from the middle, and then increases again at the other end of the acupressure member.

In addition, the cross section rotates from an end of the acupressure member toward the middle in a different direction from a direction it rotates from the middle toward the other end of the acupressure member.

In FIG. 21, the acupressure member has a pentagonal cross-sectional shape. However, the acupressure member can also have various shapes such as a triangle, a quadrilateral, a hexagon, etc. In addition, the cross section of the acupressure member can rotate various numbers of turns along the long-axis direction. For example, in FIG. 21, the cross section of the acupressure member rotates ⅕ of a turn from an end of the acupressure member toward the middle. However, the cross section of the acupressure member may also rotate ⅓ of a turn, 1 turn, or 2 turns.

Figure 22:
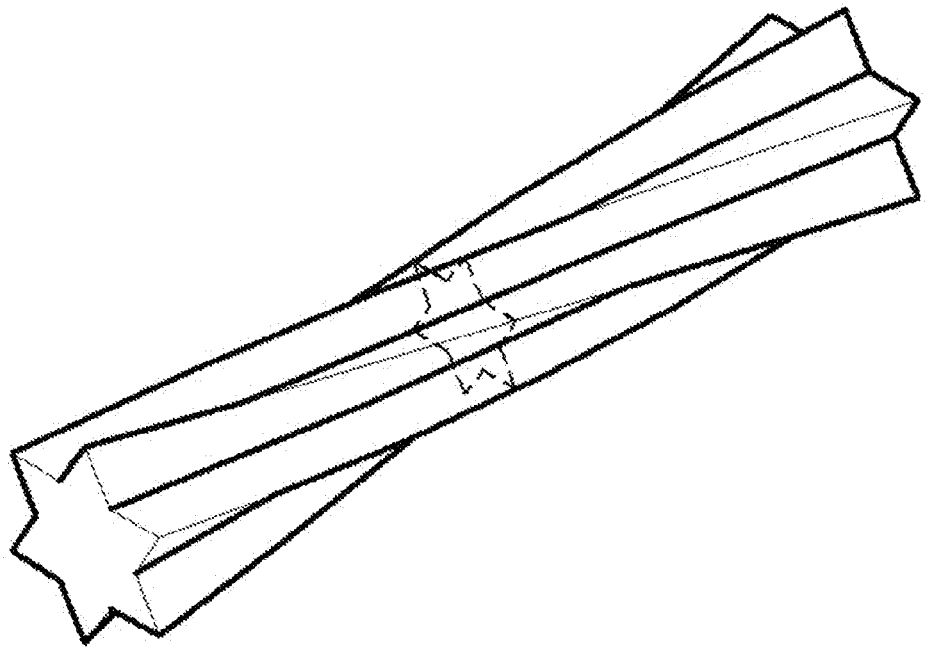

The acupressure member of FIG. 22 has a thickness pattern in which the diameter of the acupressure member is largest at both ends and smallest in the middle. In addition, the acupressure member has a cross-sectional shape consisting of six triangular protrusions.

The cross-sectional shape changes in size as it rotates in one direction along the long-axis direction.

Figure 23:
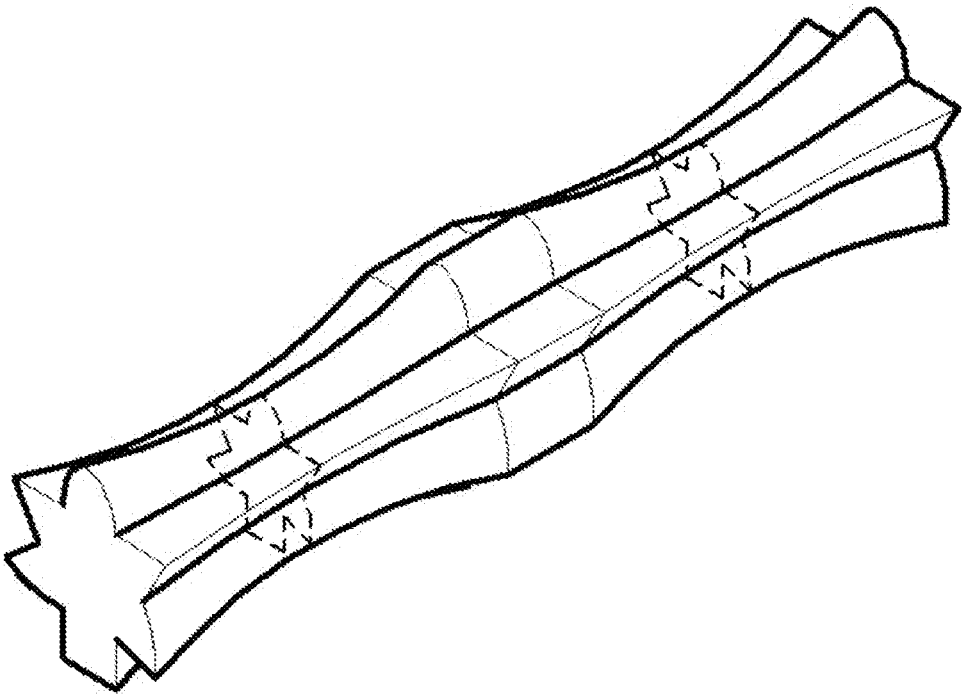

The acupressure member of FIG. 23 has a thickness pattern in which the diameter of the acupressure member is largest at both ends and in the middle and smallest between both ends and the middle. In addition, a cross section of the acupressure member consists of protrusions of various shapes. That is, one cross section includes all of a circular protrusion, a triangular protrusion, a quadrilateral protrusion, and a saw-toothed protrusion.

The shape of the cross section changes only in size along the long-axis direction without rotating. That is, the cross section of the acupressure member gradually decreases in size along the long-axis direction from an end of the acupressure member, increases in the middle, gradually decreases again from the middle, and then increases again at the other end of the acupressure member.

Figure 24:
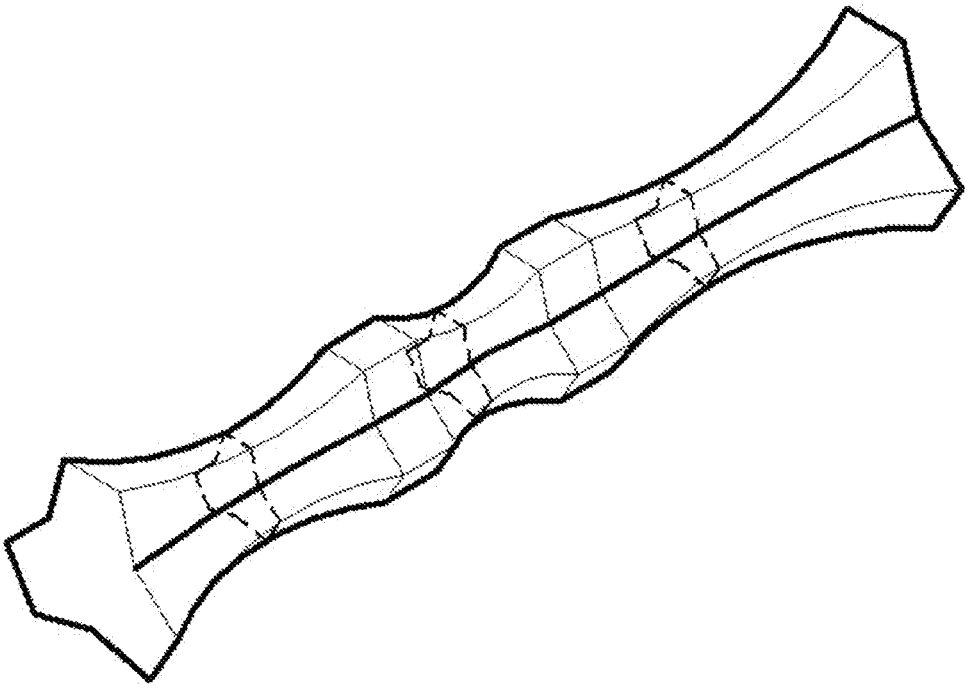

The acupressure member of FIG. 24 has a largest diameter at both ends, includes two convex portions having intermediate diameters along the long-axis direction, and has a smallest diameter between both ends and the convex portions. In addition, the acupressure member of FIG. 23 consists of three quadrilateral protrusions.

The acupressure members of FIGS. 20 through 24 have smooth surfaces. However, they can also have small-sized surface protrusions, and the surface protrusions can be formed in various sizes, numbers, and patterns.

Figure 25:
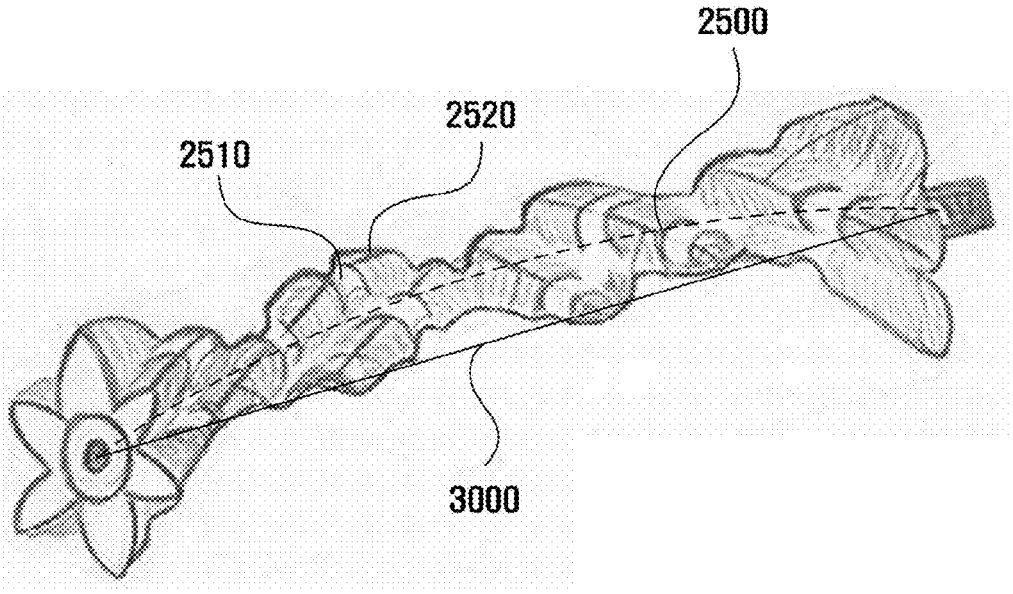

The acupressure member of FIG. 25 has a largest diameter at both ends, includes two convex portions having intermediate diameters along the long-axis direction, and has a smallest diameter between both ends and the convex portions.

The shape of a cross section of the acupressure member changes in size as it rotates along the long-axis direction. In addition, the cross section rotates from an end of the acupressure member toward the middle in a different direction from a direction it rotates from the middle toward the other end of the acupressure member.

In FIG. 25, a plurality of grooves 2510 are formed, and surface protrusions 2520 are formed by the grooves 2510.

In FIG. 25, a virtual line 2500 indicating centers of cross sections formed along a long axis does not match a virtual line 3000 connecting centers of cross sections at both ends of the acupressure member.

Figure 26:
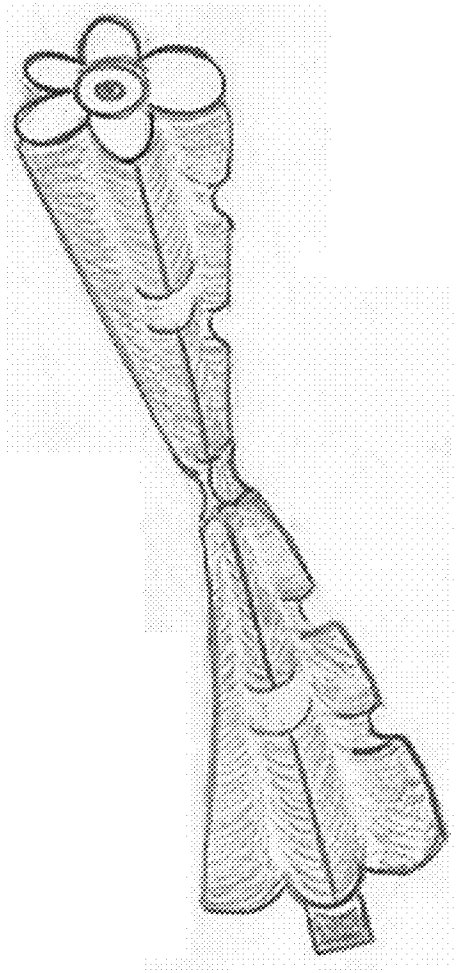

The acupressure member illustrated in FIG. 26 has a thickness pattern in which the diameter of the acupressure is largest at both ends and smallest in the middle. In addition, a cross section of the acupressure member consists of five circular protrusions.

Like the acupressure member of FIG. 26, the acupressure member of FIG. 20 has a thickness pattern in which the diameter of the acupressure is largest at both ends and smallest in the middle. However, while the diameter of the acupressure member of FIG. 20 changes in a streamlined shape along the long axis, the diameter of the acupressure member of FIG. 26 changes in a linear shape.

Like the acupressure member of FIG. 25, the acupressure member of FIG. 26 includes grooves and accordingly surface protrusions.

Figure 27:
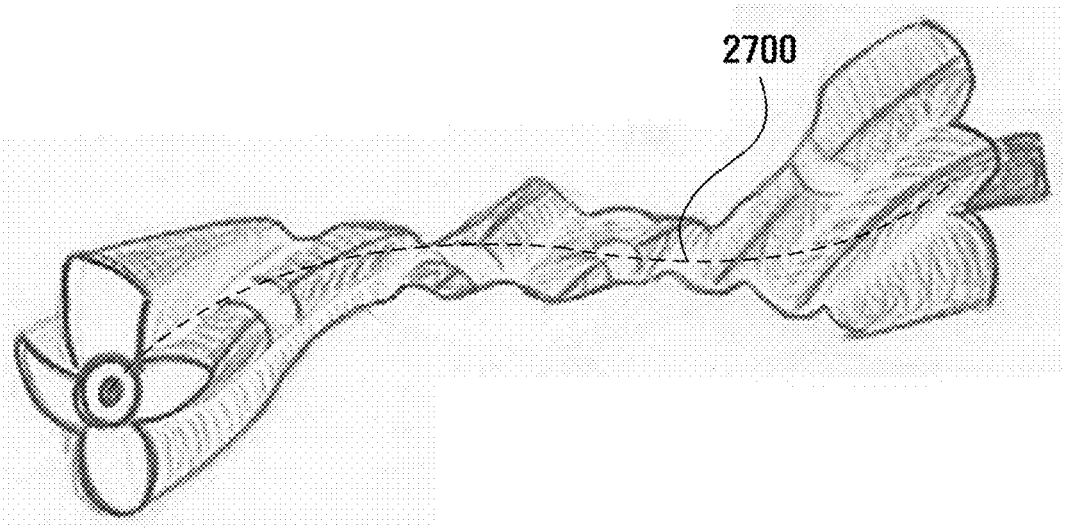

The acupressure member illustrated in FIG. 27 has a thickness pattern in which the diameter of the acupressure member is largest at both ends and smallest in the middle. In addition, a cross section of the acupressure member consists of protrusions of various shapes. That is, one cross section includes all of a circular protrusion, a triangular protrusion, a quadrilateral protrusion, and a saw-toothed protrusion.

The shape of the cross section of the acupressure member changes in size as it rotates in one direction along the long-axis direction. A virtual line 2700 indicating centers of cross sections formed along the long axis is shaped like "S."

Like the acupressure member of FIG. 25, the acupressure member of FIG. 27 includes grooves and accordingly surface protrusions.

Figure 28:
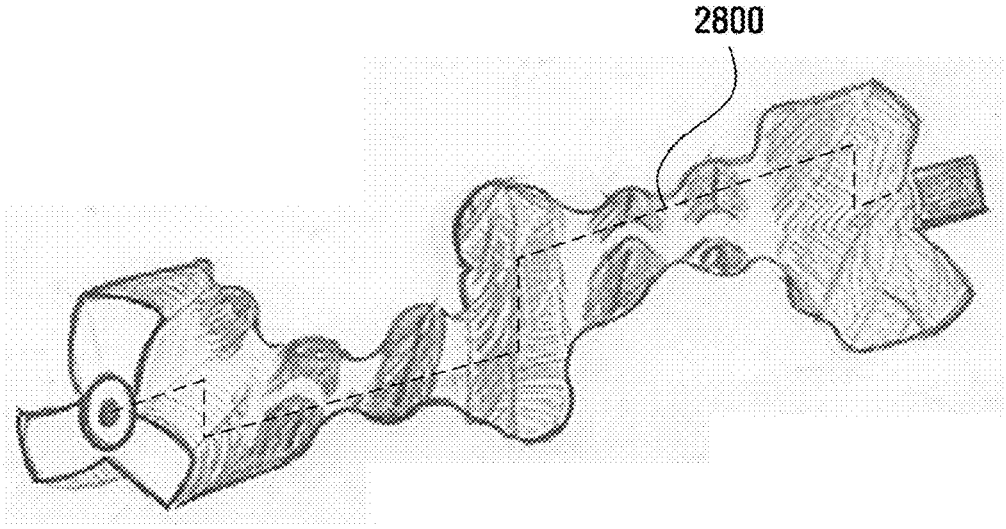

The acupressure member illustrated in FIG. 28 has a thickness pattern in which the diameter of the acupressure member is largest at both ends and in the middle and smallest between both ends and the middle. In addition, a cross section of the acupressure member consists of quadrilateral protrusions.

The shape of the cross section of the acupressure member changes in size as it rotates in one direction along the long-axis direction. A virtual line 2800 indicating centers of cross sections formed along the long axis is shaped like "ㄹ".

Like the acupressure member of FIG. 25, the acupressure member of FIG. 28 includes grooves and accordingly surface protrusions.

Figure 29:
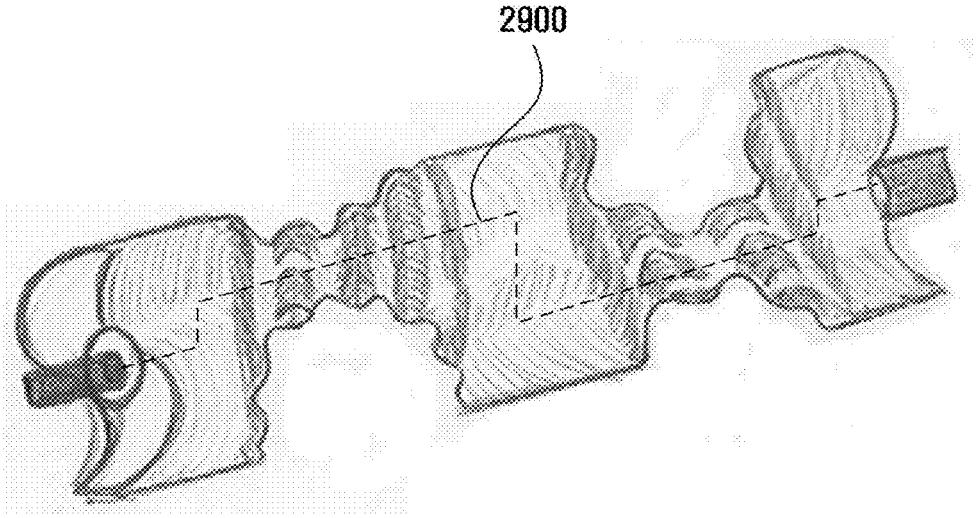

The acupressure member illustrated in FIG. 29 has a thickness pattern in which the diameter of the acupressure member is largest at both ends and in the middle and smallest between both ends and the middle. In addition, a cross section of the acupressure member consists of semicircular protrusions.

The shape of the cross section of the acupressure member changes in size as it rotates in one direction along the long-axis direction. A virtual line 2900 indicating centers of cross sections formed along the long axis is shaped like "ㄹ".

Like the acupressure member of FIG. 25, the acupressure member of FIG. 29 includes grooves and accordingly surface protrusions.

While the present invention has been particularly shown and described with reference to exemplary embodiments thereof, it will be understood by those of ordinary skill in the art that various changes in form and detail may be made therein without departing from the spirit and scope of the present invention as defined by the following claims. The exemplary embodiments should be considered in a descriptive sense only and not for purposes of limitation.

The invention claimed is:

1. A massage apparatus comprising:

a support frame; and one or more acupressure assemblies, each acupressure assembly comprising:

an acupressure frame operably coupled to the support frame, a first acupressure support operably coupled to the acupressure frame, the first acupressure support housing a first power source for rotating a first acupressure member fixed to the first acupressure support, a second acupressure support operably coupled to the acupressure frame, the second acupressure support housing a second power source for rotating a second acupressure member fixed to the second acupressure support; and an auxiliary acupressure assembly comprising:

an auxiliary acupressure member, the auxiliary acupressure member powered by a third power source;

a fixing unit which is attached to the support frame;

a slide unit operably coupled to the fixing unit, the slide unit being slidable in a sliding direction within a predeterimined range in close contact with the fixing unit; and an auxiliary acupressure support operably coupled to the slide unit and the auxiliary acupressure member, the auxiliary acupressure support housing the third power source, the third power source providing power to the auxiliary acupressure member for rotatable movement, the auxiliary acupressure support movable in a reciprocating motion in a direction perpendicular to the sliding direction of the slide unit while supporting the auxiliary acupressure member.

2. The massage apparatus of claim 1, wherein each of the first and second acupressure supports are movable on the acupressure frame.

3. The massage apparatus of claim 2, wherein each acupressure support moves in a reciprocating motion in a specified path along the acupressure frame.

4. The massage apparatus of claim 3, wherein each acupressure member is at a fixed distance from a respective acupressure support.

5. The massage apparatus of claim 1, further comprising a control unit which controls movements of the one or more acupressure assemblies and the auxiliary acupressure assembly.

6. The massage apparatus of claim 5, wherein the control unit controls individual movements or connected movements of the one or more acupressure assemblies and the auxiliary acupressure assembly.

7. The massage apparatus of claim 1, wherein the first and second acupressure members and the auxiliary acupressure member have different shapes.

8. The massage apparatus of claim 7, wherein the shape of each of the first and second acupressure members and the shape of the auxiliary acupressure member are determined by at least one of a thickness pattern formed along a long-axis direction, a cross-sectional shape, a size of surface protrusions, the number of surface protrusions, a pattern of surface protrusions, and a position pattern of centers of cross sections formed along a long axis with respect to a virtual line connecting centers of cross sections at both ends of the acupressure member.

9. The massage apparatus of claim 8, wherein the cross-sectional shape comprises at least one of a size of a cross section formed along the long-axis direction, whether or not the cross section rotates, a rotational pattern of the cross section, shapes of protrusions included in the cross section, and the number of protrusions.

10. The massage apparatus of claim 1, wherein the support frame is comprised of a plurality of sub-support frames, wherein one of the sub-support frames serves as a base sub-support frame, and the other sub-support frames rotate in a direction around an axis of the base sub-support frame.

11. The massage apparatus of claim 1, wherein each acupressure member is independently rotated by a respectively independent motor.

12. The massage apparatus of claim 1, wherein the acupressure frame is rotatably coupled to the support frame.

13. A massage apparatus comprising:

a support frame;

one or more acupressure assemblies, which rotate in one direction around one axis of the support frame, each acupressure assembly comprising: one or more acupressure members, each acupressure member directly rotated by a separate power source and each supported by a separate first acupressure support; and an auxiliary acupressure assembly comprising:

a fixing unit which is attached to the support frame, a slide unit which slides in a sliding direction within a predetermined range in close contact with the fixing unit, an auxiliary acupressure member directly rotated by a separate power source, and an auxiliary acupressure support which moves in a reciprocating motion in a direction perpendicular to a sliding direction of the slide unit while supporting the auxiliary acupressure member.

14. The massage apparatus of claim 13, further comprising a pivoting member positioned on the support frame, wherein the one or more acupressure assemblies is coupled to and pivots about the pivoting member.

15. The massage apparatus of claim 13, wherein the slide unit is operably coupled to the auxiliary acupressure support, the slide unit movable from the first acupressure support in a first plane of motion; and wherein the fixing unit is operably coupled to the slide unit, the fixing unit movable relative to the slide unit in a second plane of motion.

16. The massage apparatus of claim 15, wherein the first plane of motion is perpendicular to the second plane of motion.

17. The massage apparatus of claim 16, wherein the auxiliary acupressure member is rotatably coupled to the auxiliary acupressure support.

* * * * *